US005374226A

United States Patent [19]

Grahm

[11] Patent Number: 5,374,226

[45] Date of Patent: Dec. 20, 1994

[54] METHOD AND APPARATUS FOR INCREASING THE STRENGTH, FLEXIBILITY AND SPAN OF A HAND

[76] Inventor: Norman B. Grahm, P.O. Box 23801, Lexington, Ky. 40523-3801

[21] Appl. No.: 869,327

[22] Filed: Apr. 15, 1992

[51] Int. Cl.[5] ..... A63B 23/16

[52] U.S. Cl. ..... 482/47; 482/44; 482/907; 601/40

[58] Field of Search ..... 482/907, 44, 47, 130; 128/26, 65, 370; 84/467, 468, 469; 5/623, 646, 647; 602/2

[56] References Cited

U.S. PATENT DOCUMENTS

| | | | |
|---|---|---|---|
| 806,681 | 12/1905 | Kursheedt | 482/47 |
| 886,591 | 5/1908 | Finger | 482/47 |
| 3,286,711 | 11/1966 | MacLeod | 128/65 |
| 4,082,257 | 4/1978 | Strickland | 5/647 |
| 4,173,216 | 11/1979 | Nolet | 128/26 |
| 4,497,313 | 2/1985 | Kurosawa | 128/370 |
| 4,674,110 | 6/1987 | Eaton et al. | 5/647 |
| 4,774,966 | 10/1988 | Lemmen . | |
| 4,822,027 | 4/1989 | Kascak | 482/130 |
| 4,880,415 | 11/1989 | Urakami | 128/370 |

FOREIGN PATENT DOCUMENTS

| | | | |
|---|---|---|---|
| 0167484 | 1/1922 | United Kingdom | 482/47 |

*Primary Examiner*—Richard J. Apley
*Assistant Examiner*—Lynne A. Reichard
*Attorney, Agent, or Firm*—King and Schickli

[57] ABSTRACT

An apparatus for stretching the span of a hand includes a base member and a pair of spaced pegs; one peg for engaging the first metacarpal and one peg for engaging the fifth metacarpal of the hand. The pegs are mounted for relative adjustment in the base member. More particularly, the peg for engaging the first metacarpal is received in a straight guide way or slot extending through the base member. The second peg for engaging the fifth metacarpal is received in an arcuate guide track or slot extending through the base member in an arc about the first peg. Graduations are provided to identify relative positions along the guide way and guide track. A method for stretching the span of a hand includes engaging the hand between the first and second metacarpals with a first peg and between the fourth and fifth metacarpals at a spaced stretching distance with a second peg. Next is repeatedly pressing the hand against the pegs to provide stretching. The apparatus may include and the method may be performed in a warm water bath to make the bones, tendons and muscles of the hand more supple during treatment.

19 Claims, 2 Drawing Sheets

METHOD AND APPARATUS FOR INCREASING THE STRENGTH, FLEXIBILITY AND SPAN OF A HAND

TECHNICAL FIELD

The present invention relates generally to the field of occupational/physical therapy and, more particularly, to a method and apparatus of hand therapy for increasing the strength and flexibility of the fingers as well as the span of the hand.

BACKGROUND OF THE INVENTION

Carpal tunnel syndrome is a common ailment of near epidemic proportions. Carpal tunnel syndrome results from compression of the median nerve. The median nerve extends down the arm, through the wrist and then branches into the hand, supplying the thumb, forefinger, middle finger and half the ring finger with nerves (the first through fourth metacarpals respectively). The portion of the wrist through which the median nerve extends is known as the carpal tunnel. The carpal tunnel is formed by the concave arch of the carpal bones and is roofed, on the palm side, by the transverse carpal ligament. Together, the carpal bones and the transverse carpal ligament form a relatively rigid compartment through which nine finger tendons and the median nerve must pass.

Synovial membranes serve as tissue lining surfaces that secrete synovial fluid to lubricate the tendons for smooth operation. When irritated or inflamed, these synovial membranes over produce synovial fluid and begin to swell. Eventually, the swelling begins filling the space of the carpal tunnel and compresses the relatively soft tissue of the median nerve. In the early stages, this condition results in pain, numbness, tingling and a weakness of the fingers and thumb especially at night and on awakening. In more severe cases, the condition progresses to a loss of feeling, loss of grip and possibly even loss of some hand function.

Carpal tunnel syndrome may be caused by a number of factors including chronic diseases such as rheumatoid arthritis and diabetes mellitus, congenital defects such as anomalous muscles., acute trauma, age, birth control pill usage and pregnancy. Many occupations requiring repetitive motion also induce the ailment. For example, repeated and forceful up and down motions of the wrist cause finger tendons to rub over and across carpal tunnel structures (i.e. carpal bones and transverse carpal ligament). This rubbing irritates the tendons which, as described above, promotes over production of synovial fluid and swelling that eventually puts pressure on the median nerve inside the tunnel. Tasks requiring sustained or repeated stress over the base of the palm such as often occur when utilizing screwdrivers, scrapers and buffers also significantly raise the risk of suffering from the ailment. In fact, this ailment is now recognized by the government as being a major contributor to lost productivity.

Early identification of carpal tunnel syndrome allows the utilization of conservative treatment techniques. Such techniques include improvements in work area ergonomics to relieve the stresses that irritate and inflame the synovial membranes that swell and close the carpal tunnel. A splint may also be fitted to the wrist to hold the wrist in a functional position and prevent the wrist from being placed in extension and flexion.

In more severe cases, surgery may be necessary to release the transverse carpal ligament and open the carpal tunnel. More particularly, surgery consists of incising the transverse carpal ligament of the wrist and then placing the wrist in a splint for a short time to allow healing. As stiffness and pain often develop following surgery due to what is known as "sympathetic dystrophy" prolonged therapy is often necessary before an individual is able to return to work following such surgery. This therapy is specifically designed to restore strength and flexibility to the wrist and fingers with a goal of increasing flexibility and grip strength at least to that provided before the surgery and existence of the ailment.

In the past, such therapy has often consisted of wearing a wrist splint, as mentioned above, and completing squeezing exercises utilizing a soft rubber ball. In some instances, hand flexibility and finger spread are reestablished by taping small balls between the fingers to hold them in a spread position overnight. None of the prior art treatment procedures known to the applicant address increasing the suppleness of the hand, including the bones, tendons and muscles, to aid in treatment during the actual stretching procedure. Accordingly, in many cases, the patient is slow to respond to such a treatment procedure. Thus, the procedure has only met with limited success. A need is, therefore, identified for a new apparatus and method of providing hand therapy to aid in recovery from carpal tunnel syndrome.

SUMMARY OF THE INVENTION

Accordingly, it is a primary object of the present invention to provide a method and apparatus for permanently increasing the strength and flexibility of the fingers.

Another object of the present invention is to provide a method and apparatus of hand therapy particularly adapted for countering the effects of carpal tunnel syndrome and increasing the strength and flexibility of the fingers, including the grip strength, to a level at least commensurate with that for the individual prior to suffering from the ailment.

Still another object of the present invention is to provide a method and apparatus for stretching the span of the hand as defined by the spread angle between the first and fifth metacarpals (i.e. thumb and little finger). Advantageously, increased hand span is known to improve the performance of individuals in certain occupations. For example, increased hand span can aid a football player in catching a football and a basketball player in handling the ball while dribbling. Further, increased hand span can aid a pianist in comfortably reaching the necessary keys to strike particular chords required in playing certain musical pieces.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an apparatus and method are provided for stretching the hand span of a patient as defined by the spread angle between the thumb or first metacarpal and little finger or fifth metacarpal. More particularly, the apparatus includes a base member having a guide way and an arcuate guide track. Means such as a peg is provided in the guide way for engaging the first metacarpal. Means, again such as a peg, is provided in the arcuate guide track for engaging the fifth metacarpal.

Preferably, each of the pegs includes quick-release fasteners that allow the position of the pegs on the guide way and guide track to be adjusted and then held in a selected fixed position.

Advantageously, by adjusting the spaced stretching distance between these pegs, the device may be adjusted to provide the desired stretching force to any individual's hand during use. Further, two additional pegs may be provided for engaging between the second and third metacarpals and also the third and fourth metacarpals. These additional pegs may be left free-floating in the guide track so as to better conform to the geometry of the hand being treated while still providing the desired stretching force to increase finger spread and flexibility. Graduations may be provided on the base member to allow the relative positions of the pegs to be determined and adjusted as necessary to increase the span of the hand over the course of the therapy.

In order to enhance the effectiveness of the therapy, the apparatus may also include a water bath. This water bath includes a bracket to rigidly hold the base member during therapy. Preferably, the water bath also includes a pump and thermostatically controlled heat source. As water is recirculated by the pump it passes through the heat source where it is brought to the desired temperature of approximately 100°–110° F. The water is then returned to the bath through a jet that directs the water over the back of the hand during treatment.

According to the method of the present invention, the first and second pegs are adjusted so as to be in the desired position along the guide way and guide track to provide a spaced stretching distance therebetween particularly adapted for furnishing the desired stretching force to the hand receiving therapy. The base member is then preferably positioned in the water bath. The hand to be treated is then positioned relative to the device so that the first peg engages between the first and second metacarpals and the second peg engages between the fourth and fifth metacarpals. Next the hand is repeatedly pressed against the pegs to spread the first and fifth metacarpal and thereby stretch the overall spread or span of the hand. Alternatively, the hand may be pushed into place against the pegs to provide stretching and then held stationary. As this is done, warm pulsating water may be provided over the back of the hand to massage the tendons and tissues. This procedure also provides effective stretching.

Over time it is possible to further stretch the span of the hand by gradually increasing the spaced stretching distance between the pegs. The graduations ensure that the desired additional stretching force is provided during each treatment. Of course, by immersing the hand in warm water while repeatedly pressing the hand against the pegs, the hand and, more particularly, the bones, tendons and muscles within the hand are made more supple thereby aiding in the effectiveness of the treatment.

Advantageously, the treatment of the present invention not only stretches the span of the hand of the patient but improves flexibility. Accordingly, not only is the present invention useful in increasing the span of the hand for those involved in occupations where this is of benefit but it also is useful in aiding in the recovery from various trauma injuries and ailments such as carpal tunnel syndrome.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawing and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
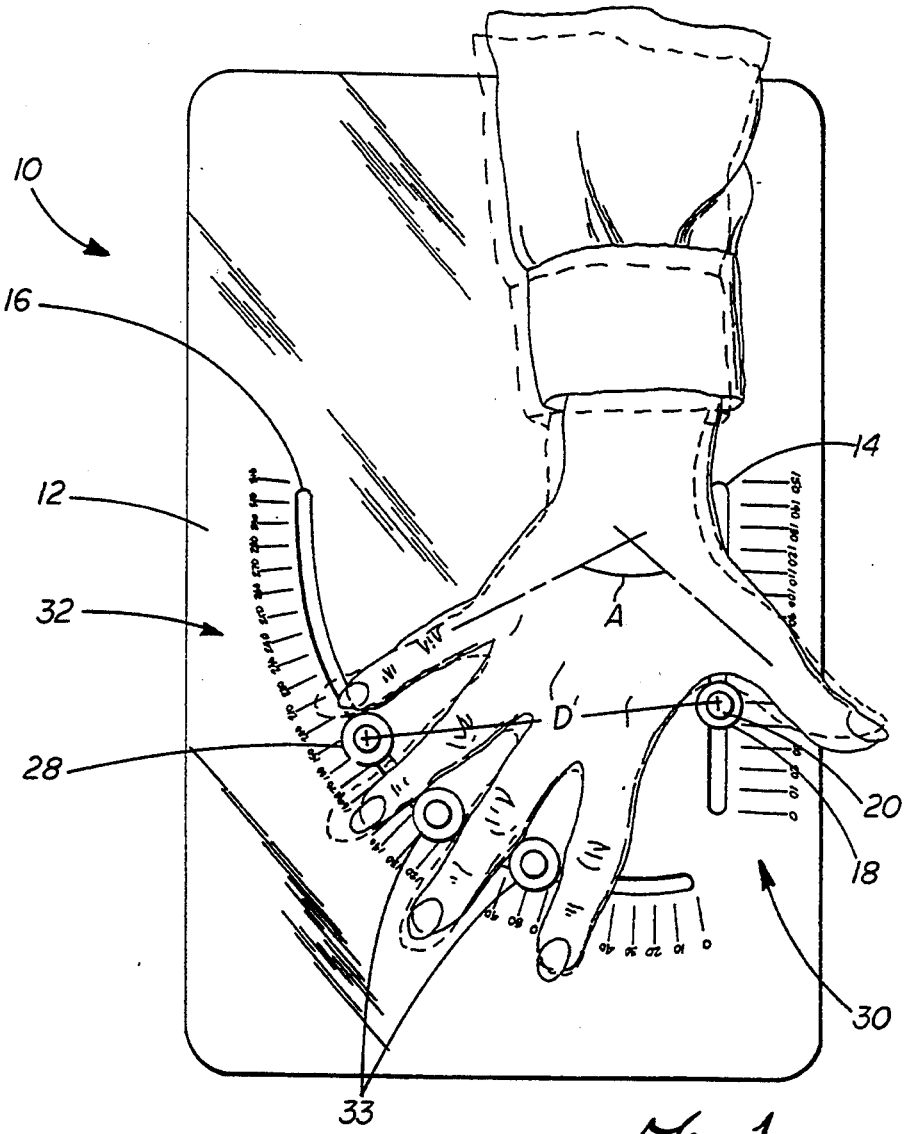
FIG. 1 is a plan view of the apparatus of the present invention illustrating the movement of the hand during treatment to provide stretching of the span.

Reference is now made to the drawing figures and particularly FIG. 1 showing the apparatus 10 of the present invention for stretching the span of the hand. In accordance with the present invention, this span is defined as the angle A formed between the first and fifth metacarpals as defined by imaginary lines extending from the first metacarpal or thumb and fifth metacarpal or little finger to a point of intersection. By increasing the span of the hand between the first and fifth metacarpal, participants in sports such as basketball and football are better able to catch, hold and handle the ball.

Individuals from other occupations can also benefit from an increase in hand span. For example, exercising with the apparatus 10 of the present invention will allow a pianist to play certain chords that require a long stretch between the fingers to press the appropriate keys. Further, a pianist or even a guitarist would benefit from the increased flexibility and resulting dexterity provided in the hands and fingers after exercising with the present apparatus 10 as described below. Further, it should be appreciated that the present apparatus 10 has significant therapeutic value in restoring the flexibility and gripping power of a patient recovering from certain trauma injuries and other ailments.

The apparatus 10 of the present invention comprises a base member 12, in the form of a plate. The base member 12 may, for example, be formed from stainless steel or a plastic such as nylon. As best shown in FIG. 1, the base member 12 includes a straight guide way 14 and an arcuate guide track 16. Both the guide way 14 and guide track 16 are formed as slots that extend completely through the base member 12.

Figure 2:
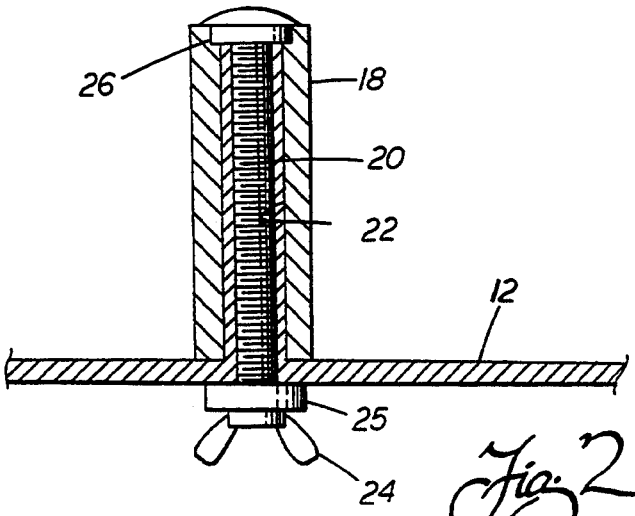
FIG. 2 is a detailed sectional view showing the connection of a peg to either the guide way or guide track in the base member of the apparatus shown in FIG. 1.

One cylindrical peg 18 of metal, plastic or other appropriate material is positioned in the guide way 14. More particularly, the peg 18 is mounted for selective positioning along the guide way 14 by means of a quick-release fastener. As best shown in FIG. 2, the releasable fastener may comprise a carriage bolt 20 that extends through a central bore 22 in the peg 18 as well as the guide way 14 in the base member 12. A wing nut 24 and low friction, nylon washer 25 are secured to the threaded distal end of the carriage bolt 20. When the wing nut 24 is tightened, the peg 18 is secured in a set position in the guide way 14 on the base member 12. A four sided counterbore 26 adjacent the top of the peg 18 ensures that the carriage bolt 20 does not rotate when the wing nut 24 is tightened. The counterbore 26 also serves the same function when the wing nut 24 is loosened to allow one to slide the peg 18 along the guide way 14 and place it in a different operative position. Of course, it should be appreciated that a releasable fastener of a different design could be utilized and that the carriage bolt 20 and a wing nut 24 fastener is only presented for purposes of illustration and, therefore that the present invention is not limited thereto.

A second peg 28 is mounted in the arcuate guide track 16 by means of a carriage bolt 20 and a wing nut 24 as described above with respect to the peg 18. As described in greater detail below, the peg 18 is adapted to engage the first metacarpal or thumb and the peg 28 is adapted to engage the fifth metacarpal or little finger. The pegs 18 and 28 are fixed in position along the guide way 14 and guide track 16, respectively, so as to define a spaced stretching distance D therebetween. By adjusting the relative position of the pegs 18, 28 along the guide way 14 and guide track 16, respectively, that spaced stretching distance may be altered to provide the desired stretching force on the first and fifth metacarpals necessary to increase the span of the hand without damaging the hand. The relative positioning of the peg 18 along the guide way 14 may be determined by viewing the graduation scale 30. Similarly, the relative positioning of the peg 28 along the guide track 16 may be determined by viewing the graduation scale 32.

Additional pegs 33 of identical design may also be provided on the guide track 16 for interdigitating engagement between the second and third metacarpals and third and fourth metacarpals. These additional pegs 33 aid in the stretching process. More particularly, through exercising in the manner described below, these pegs 33 serve to increase the flexibility of the ring, middle and index or forefinger as well. Further, when utilized together, the pegs 18, 28 and 33 effectively provide proper symmetry to the hand in its new, stretched condition following treatment.

In order to provide more effective treatment and insure that the stretching forces are properly applied to the bones, muscles and tendons of the ring, middle and index fingers, preferably, the pegs 33 are not tightened down and fixed in position but instead remain free floating in the guide track 16. This allows the apparatus 10 and pegs 33 to better conform to the hand geometry of the patient, generally, and the particular geometrical changes that occur as the hand undergoes stretching exercises. The free floating nature of the pegs 33 also insures that the stretching forces are spread equally over the metacarpals extending around the individual pegs 33. Of course, it should be appreciated that it may also be necessary to vary the diameter of the pegs 33 or even the pegs 18, 28 to provide the most effective treatment. The treatment procedure, diameter of the pegs 18, 28, 33 selected and stretching distance D are always determined after first completing an analysis of the hand or hands of the patient to receive treatment.

Figure 3:
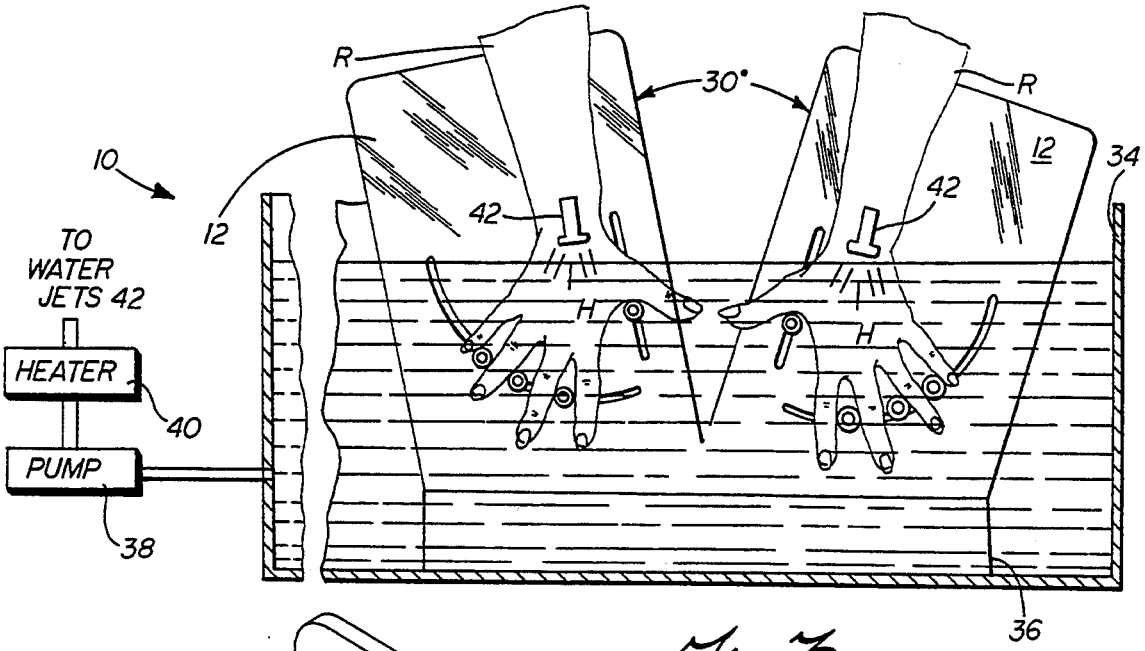
FIG. 3 is a schematical sectional view showing simultaneous treatment of both hands in a heated water bath.

In order to aid in the stretching process, it is desirable to ensure that the hand is warm and that the associated bones, tendons and muscles are supple. Accordingly, as best shown in FIG. 3, the base member 12 is preferably positioned down in a water bath 34. A bracket 36 in the water bath 34 engages the base member 12 to rigidly hold it in position. A pump 38 circulates the water from the bath 34 through a thermostatically controlled heating element 40 that maintains the water at the desired temperature of, for example, 100° to 105° F. to even as high as 110° F. Water jets 42 are provided for directing the heated and recirculated water over the back of the hand or hands H as they are manipulated against the pegs 18, 28. Preferably, a pulsing water jet is utilized.

More specifically, the heads of pulsating water jets 42 are preferably positioned adjacent the hand or hands H undergoing treatment. Ideally, a spray pattern is provided that covers the back of the wrist(s) and hand(s) H. In this way a warm water massaging action is obtained over the bones, tendons and muscles receiving treatment. This action serves to enhance the stretching effect and aids in the successful completion of the treatment or therapy.

The operation of the apparatus 10 and the method of stretching the span of a hand H will now be described in detail. Initially, the pegs 18 and 28 are properly positioned along the guide way 14 and guide track 16, respectively, in order to provide the desired stretching distance D therebetween. This is accomplished by loosening the wing nut 24 of peg 18 and then sliding the peg 18 along the guide way 14 until it reaches the desired position. The wing nut 24 is then tightened to securely hold the peg 18 in position. The same procedure is then followed with respect to peg 28 in order to secure that peg at the desired position along the guide track 16 of the base member 12. The resulting stretching distance D between the pegs 18, 28 should allow the pegs to be easily engaged by the first and fifth metacarpals of the hand as shown in full line in FIG. 1.

After the pegs 18 and 28 are set in position, the base member 12 is position in the bracket in the water bath 34. As shown in drawing FIG. 3, both hands may be treated at the same time by positioning two mirror image apparatus 10 in the water bath 34 simultaneously; one for exercising the right hand and one for exercising the left hand. Preferably, the apparatus 10 are positioned in the bath 34 at substantially a 30 degree angle with respect to one another. Such positioning serves to accommodate elbow bend and the spacing between the arms R due to the shoulders.

As indicated above, the water in the water bath 34 is maintained at a relatively high temperature of, for example 100° to 105° F. Prior to utilizing the apparatus 10, the individual places and holds his hands H in the water bath for a period of, for example, from five to fifteen minutes. This allows the heat from the water to penetrate deep into the hands H so that the bones, tendons and muscles are more supple to allow more effective stretch treatment. The hands H are then positioned on the appropriate apparatus 10 with the first metacarpal or thumb engaging the corresponding peg 18 and the fifth metacarpal or little finger engaging the corresponding peg 28. The second, third and fourth metacarpals are interdigitated around the free floating pegs 33 for treatment of each entire hand H.

Once properly positioned as shown, the hands are pressed toward the pegs 18, 28 as far as possible (note phantom line position of hand in FIG. 1). As this is done, the pegs 18 slide further into the space between the first and second metacarpals and the pegs 28 slide deeper into the space between the fourth and fifth metacarpals. The smooth cylindrical contour and low friction material of the pegs 18, 28 ensures smooth movement. Further, the engagement of the peg 18 against the inner face of the first metacarpal and the engagement of the peg 28 against the inner face of the fifth metacarpal during pressing ensures that a stretching force is presented that effectively increases the span of each hand.

After pressing the hands H against the pegs 18, 28 and holding them in the phantom line position for a short period of time such as, for example, two to ten seconds, the hands are returned to the original starting position shown in full line. The above-described movement cycle is then repeated anywhere from 50 to 200 times during each treatment. A complete treatment should last between approximately twenty and forty-five minutes. Gradually over tine, the span of the hands is increased without damaging the bones, tendons or muscle structure. The strength of the fingers and grip as well as overall flexibility are also enhanced during this therapy.

In the event additional increases in hand span and/or flexibility are desired, the stretching distance D between the pegs 18, 28 may be reset and increased by sliding the pegs along the guide way 14 and guide track 16 and anchoring them in new positions. The treatment procedure is then repeated in the manner described above to further increase the span of the hands H.

Figure 4:
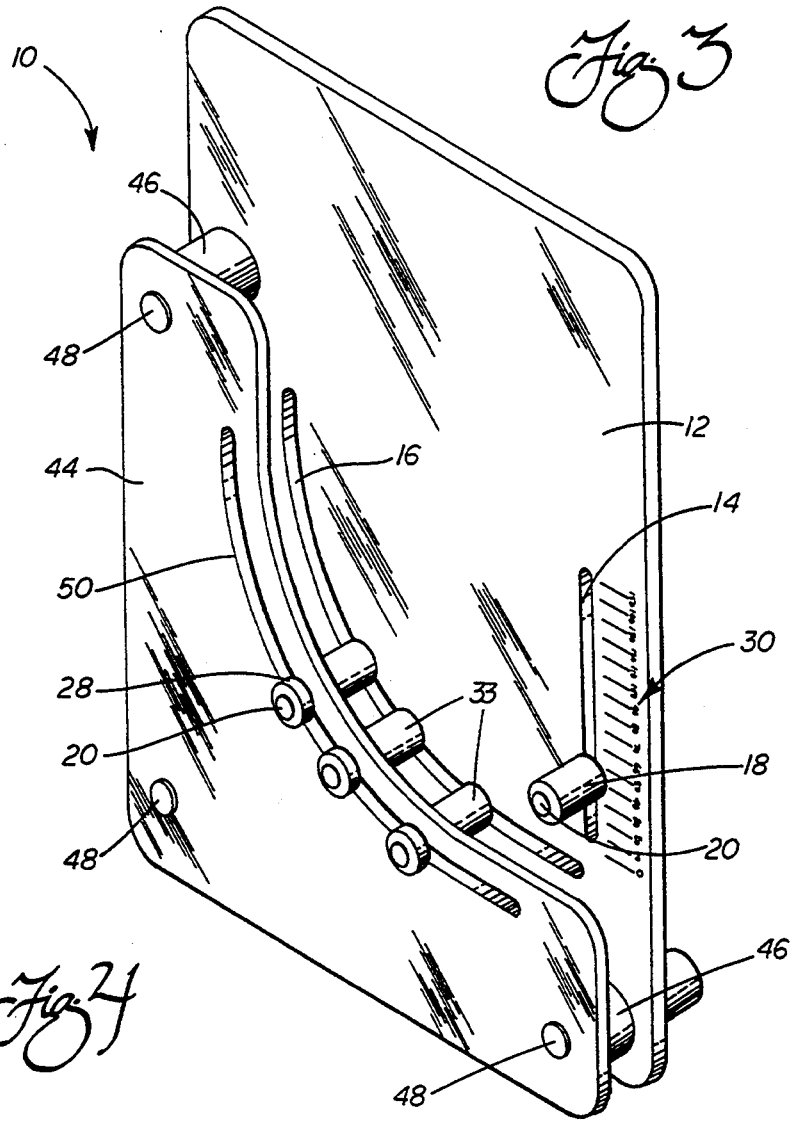
FIG. 4 is a perspective view of an alternative embodiment of the present invention.

An alternative embodiment of the present invention 10' is shown in FIG. 4. The alternative embodiment includes all of the features of the above-described embodiment. For purposes of clarity, these structural features are identified with the same reference numerals. Additionally, the alternative embodiment includes a stabilizing plate 44 that extends in a plane parallel to the base member 12 and is mounted thereto by a series of three posts 46. Again, carriage bolts or other fasteners 48 may be utilized to secure the base member 12, stabilizing plate 44 and posts 46 in position.

As shown, the stabilizing plate 44 also includes an arcuate guide track 50. The guide track 50 is positioned to directly overlie and be aligned with the guide track 16 in the base member 12. The stabilizing plate 44 may also include graduations (not shown) such as described above for determining any relative position along the guide track 16, 50.

As shown in FIG. 4, the peg 28' that is received in the arcuate tracks 16, 50 is of two piece construction. The stabilizing plate 44 is sandwiched between the two pieces of the peg 28'. A carriage bolt 20 extends through the two pieces and the two arcuate guide tracks 16, 50. A wing nut and washer (not shown) secures the peg 28' in position in the manner described above.

In summary, numerous benefits result from employing the concepts of the present invention. The apparatus 10 is particularly adapted for stretching the span of the hand as identified by the spread angle formed between the first and fifth metacarpals. An increase in hand span benefits individuals in a number of occupations such as those requiring gripping of relatively large objects or an extensive span. The apparatus may also be effectively used for hand therapy. Particularly, the apparatus is adapted to improve flexibility and grip strength. For example, the apparatus can be used to restore hand function in patients recovering from carpal tunnel syndrome.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, hot towels, a heat lamp, a heating pad or an exothermic balm could be utilized to warm the hand prior to and during treatment in place of the warm water bath. Further, a combined cam lock and wave washer fastener may be utilized in place of the carriage bolt and wing nut arrangement described to releasably fasten the pegs in position. With respect to the method, it should also be appreciated that therapy may be individualized to spacing between any two metacarpals if desired. For example, the spacing between the second and third metacarpals may be expanded or stretched by pushing the index and middle fingers back and forth around opposing sides of a single peg.

The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. An apparatus for stretching the span of a hand of a patient as defined by the spread angle between the first and fifth metacarpals, comprising:

a base member including a straight guide way;

means for engaging the first metacarpal;

means for mounting said means for engaging the first metacarpal in a selected fixed position in said straight guide way on said base member; and means for engaging the fifth metacarpal mounted on said base member a spaced stretching distance from said means for engaging the first metacarpal.

2. The apparatus set forth in claim 1, further including an arcuate guide track on said base member.

3. The apparatus set forth in claim 2, wherein said means for engaging said fifth metacarpal includes means for mounting in a selected, fixed position on said guide track.

4. The apparatus set forth in claim 3, further including graduations for identifying relative positions along said guide track.

5. The apparatus set forth in claim 3, wherein said arcuate track is a slot extending through said base member and said mounting means is a releasable fastener.

6. The apparatus set forth in claim 1, wherein said guide way is a slot extending through said base member and said mounting means is a releasable fastener.

7. The apparatus set forth in claim 1, further including graduations for identifying relative positions on said guide way.

8. The apparatus set forth in claim 1, further including means for heating said hand receiving treatment.

9. The apparatus set forth in claim 1, further including a water bath for receiving said base member and means for heating water in said water bath to make said hand more supple during stretching treatment.

10. The apparatus set forth in claim 9, further including means for circulating water in said bath and means for directing said circulating water over the back of said hand during treatment.

11. An apparatus for stretching the span of a hand of a patient as defined by the spread angle between the first and fifth metacarpels, comprising:

a base member including a guideway and a separate, independent guidetrack spaced relative to said guideway on said base member;

means for engaging the first metacarpal mounted for sliding movement along and selected positioning on said guideway; and means for engaging the fifth metacarpal mounted for sliding movement along and selected positioning on said guide track whereby selected positioning of the means for engaging the first metacarpal and means for engaging the fifth metacarpal allow for the stretching of the span of the hand of the patient.

12. The apparatus set forth in claim 11 wherein said guide track is arcuate.

13. The apparatus set forth in claim 11 further including graduations for identifying relative positions along said guide track.

14. The apparatus set forth in claim 11 wherein said means for engaging the first metacarpal is a peg and a releasable fastener is provided for mounting said peg on said guideway.

15. The apparatus set forth in claim 11, wherein said means for engaging the fifth metacarpal is a peg and a releasable fastener is provided for mounting said peg on said guidetrack.

16. The apparatus set forth in claim 11, further including graduations for identifying relative positions along said guideway.

17. The apparatus set forth in claim 11 further including means for heating the hand receiving treatment.

18. The apparatus set forth in claim 11 further including a water bath for receiving said base member and means for heating water in said water bath to make the hand more supple during stretching treatment.

19. The apparatus set forth in claim 18, further including means for circulating water in said bath and means for directing said circulating water over the back the hand during treatment.

* * * * *

UNITED STATES PATENT AND TRADEMARK OFFICE

CERTIFICATE OF CORRECTION

PATENT NO. : 5,374,226

DATED : December 20, 1994

INVENTOR(S) : Norman B. Graham

It is certified that error appears in the above-indentified patent and that said Letters Patent is hereby corrected as shown below:

On the title page item [76], change "Norman B. Grahm" to --NORMAN B. GRAHAM--.

Signed and Sealed this

Fourth Day of April, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,374,226

DATED : December 20, 1994

INVENTOR(S) : Norman B. Graham

It is certified that error appears in the above-indentified patent and that said Letters Patent is hereby corrected as shown below:

On the title page, item [76] Inventor: change the name of the inventor from "Norman B. Grahm" to —NORMAN B. GRAHAM—.

Signed and Sealed this

Twenty-third Day of May, 1995

*Attest:*

Bruce Lehman

BRUCE LEHMAN

*Attesting Officer*

*Commissioner of Patents and Trademarks*